US005133641A

United States Patent [19]

Groenendaal, Jr. et al.

[11] Patent Number: 5,133,641

[45] Date of Patent: Jul. 28, 1992

[54] SUPPORT ARRANGEMENT FOR OPTIMIZING A LOW PRESSURE STEAM TURBINE INNER CYLINDER STRUCTURAL PERFORMANCE

[75] Inventors: John C. Groenendaal, Jr., Winter Springs; John J. Anemone, Orlando, both of Fla.

[73] Assignee: Westinghouse Electric Corp., Pittsburgh, Pa.

[21] Appl. No.: 649,509

[22] Filed: Feb. 1, 1991

[51] Int. Cl.[5] ..... F01D 25/26

[52] U.S. Cl. ..... 415/213.1; 248/672

[58] Field of Search ..... 415/213.1, 214.1, 108; 248/650, 672

[56] References Cited

U.S. PATENT DOCUMENTS

| | | | |
|---|---|---|---|
| 3,752,427 | 8/1973 | Bellati | 415/213.1 |
| 3,754,833 | 8/1973 | Remberg | 415/213.1 |
| 3,799,482 | 3/1974 | Bellati et al. | 415/213.1 |
| 4,732,533 | 3/1988 | Remberg et al. | 415/213.1 |
| 4,863,341 | 9/1989 | Groenendaal | 415/103 |
| 4,900,223 | 2/1990 | Groenendaal | 415/190 |
| 4,915,581 | 4/1990 | Groenendaal, Jr. et al. | 415/213.1 |

FOREIGN PATENT DOCUMENTS

| | | | |
|---|---|---|---|
| 763028 | 7/1949 | Fed. Rep. of Germany | 248/672 |

*Primary Examiner*—John T. Kwon

*Attorney, Agent, or Firm*—K. Bach

[57] ABSTRACT

Apparatus is provided for increasing the bending flexibility of the horizontal joint flange of a low pressure steam turbine. The radial width of the horizontal joint flange in the support area where the turbine inner cylinder rests on the outer cylinder has been significantly reduced. In order to accommodate a reduction in the radial width of the flange in this area, the present invention provides a novel arrangement of the functional features of the cylinder support area. In a preferred embodiment the horizontal joint flange is capable of being narrowed in the radial direction due to the strategic rearrangement of the functional components in the support area. The present invention also provides retrofit steps for modifying existing turbines in order to provide the features and benefits of the improved apparatus. The present invention reduces ovality of the turbine inner cylinder rings, resulting in improved thermal performance and mechanical reliability as well as a reduction in flange induced, non-axisymmetric bolt loads in the horizontal joint flange bolts.

5 Claims, 5 Drawing Sheets

SUPPORT ARRANGEMENT FOR OPTIMIZING A LOW PRESSURE STEAM TURBINE INNER CYLINDER STRUCTURAL PERFORMANCE

FIELD OF THE INVENTION

The present invention relates to steam turbines and, more particularly, to the support arrangement for the inner cylinder of a low-pressure steam turbine.

BACKGROUND OF THE INVENTION

The provision of steam to a turbine is typically accompanied by the transfer of heat between the steam and those parts of the turbine coming into contact with the steam. This heat transfer has the tendency to create thermal distortion in various components of the turbine due primarily to thermal expansion and/or contraction occurring as a result of the heat transfer. Any resulting deformation of such turbine parts can be of two types: elastic which is recoverable upon release of the distortion, and plastic which is permanent. In certain applications plastic deformation can be significant enough to damage the horizontal joint flange of the turbine inner cylinders, requiring costly repairs and replacement of damaged parts.

Thermal distortion could also become significant enough to cause an ovalized deformation of the ends of the turbine inner cylinder. Such ovalized deformation can cause portions of the inner cylinder which are in close proximity to the rotor blades to move away from such blades resulting in increased clearance and attendant leakage. A far more serious consequence of such ovalized deformation is where portions of the inner cylinder move toward the rotor blades. If such movement is significant, the rotor blades will rub the surface of the inner cylinder causing damage and degradation of efficiency.

It is therefore desirable to minimize the effects of thermal deformation in order to preserve the efficiency as well as the proper alignment of the turbine.

The problems caused by thermal deformation of turbine components are a particularly important consideration in the design of low pressure steam turbines. In low pressure steam turbines there is a significant difference in the steam temperature at the turbine inlet and at the turbine exhaust or annulus. For example, it has been determined that steam entering a low pressure turbine inlet can have a temperature of approximately 700° F., whereas the temperature of the steam as it crosses the last row of blades can be approximately 100° F. The thermal loading resulting from such a temperature drop can cause the above described effects.

In a low pressure steam turbine, undesirable flange stiffness in the support area of the inner cylinder can contribute significantly to cause large thermal bending moments in the horizontal joint flange. Since the horizontal joint flange represents a structural component which is integral to the support of the inner cylinders, any excessive bending moments will cause thermal deformation of the semi-cylindrical cross-sectional shape of the cylinder casings or rings, causing them to deform out-of-round, i.e., the above mentioned phenomena of ovality.

As pointed out in U.S. Pat. No. 4,863,341—Groenendaal, Jr., it has been found that increasing the flexibility of the horizontal joint flange greatly reduces thermal deformation in the cylinder rings, thus minimizing the loss of efficiency due to ovality. As disclosed in the above referenced patent, a more flexible horizontal joint flange has been achieved by strategically isolating the inlet chamber of the inner cylinder, and further, by eliminating axial members between rings in the plane of the horizontal joint flange.

Although the structure described in the above referenced patent is capable of reducing the stiffness of the horizontal joint flange, only a 70% reduction of thermal deformation in the cylinder rings has been realized. Since further reduction of the thermal deformation in the cylinder rings is desired in order to achieve maximum efficiency of the turbine and operating costs savings, there remains a significant need for low cost-low maintenance technology advances in this area.

Also, in those cases where turbine operating budgets do not provide the resources necessary for replacement turbines in order to increase efficiency, the only viable alternative to keep a turbine in operation is a modification or retrofit of the existing low-pressure turbine. Although the prior art does provide steps to retrofit turbines in varying degrees, such as U.S. Pat. No. 4,900,223—Groenendaal, Jr., modification technology is necessary to increase the flexibility of the horizontal joint flange in order to increase the efficiency of the existing turbine and keep the turbine in operation.

SUMMARY OF THE INVENTION

Accordingly, it is a general object of the present invention to eliminate undesirable flange stiffness in the support area of a low pressure turbine inner cylinder. More particularly, it is an object of the present invention to provide an improved apparatus and method of fabricating same which provides for increased flexibility of the horizontal joint flange of a steam turbine.

It is another object of the present invention to provide an improved steam turbine apparatus and method of fabricating same which results in an inner cylinder horizontal joint flange having a reduced radial width and a resulting reduction in the axial width of the support feet.

It is a further object of the present invention to provide an improved apparatus and method of fabricating same which reduces the non-axisymmetric portion of the thermal loads acting on the bolts of the support area of the inner cylinder of a steam turbine.

It is yet another object of the present invention to provide an improved apparatus and method of fabricating same which provides for more reliable bolting of the horizontal joint flange of a steam turbine.

Briefly, the present invention incorporates relatively low cost improvements in the support area of a steam turbine inner cylinder which results in significantly increased flexibility of the horizontal joint flange, which in turn results in an increase in overall performance of the turbine. The present invention narrows the flange width in the radial or transverse direction in the area where the inner cylinder is supported on the outer cylinder. There is a resulting reduction in the size of the support feet which are outward perpendicular projections of the horizontal joint flange. The more narrow flange and the minimized support foot design of this invention provides increased flange bending flexibility which reduces the severity of ovality significantly.

In accordance with the above objects, in a preferred embodiment the inner cylinder comprises a horizontal joint flange which has a more narrow radial width in the cylinder support area. Reducing the width of the flange reduces the bending moment of inertia of the flange and thus, increases the flange bending flexibility. Also, the inner cylinder comprises one or more support feet which are radial projections of the flange and which are slidably connected to the outer cylinder support shelf. As a result of the narrowing of the width of the horizontal joint flange in the cylinder support area and in order to provide the necessary support for the inner cylinder on the outer cylinder support shelf, the support feet have an axial dimension which is minimized. The present invention accommodates the support bolts without any additional material, and thus the support area is smaller in size than those in existing turbines. The present invention further provides an axial alignment feature on the support feet in a direction projecting radially from the turbine rotor, for the jacking bolt and the hold-down bolt which may engage the outer cylinder support shelf. This novel arrangement of the functional features of the support area creates increased in-plane bending flexibility of the horizontal joint flange as compared to existing arrangements where the jacking and hold down bolts are aligned on the support feet in the axial direction projecting along the turbine rotor.

The present invention further provides a method for retrofitting existing turbines of the type described herein, comprising the steps of modifying the radial width of the flange and the axial width of the support feet by machining away at least as much foot material as required to expose the existing location of the hold down bolt hole and minimize the axial length. The retrofit steps further provide reusing the existing jacking bolt hole as a new hold down bolt hole, and modifying the support feet by drilling and tapping a new jacking bolt hole which is radially aligned with the new hold down bolt hole. The modification further comprises affixing a spacer block to the area between one of the modified support feet and a lug which is integral with the outer cylinder support shelf.

DETAILED DESCRIPTION OF THE PREFERRED EMBODIMENTS

Figure 1:
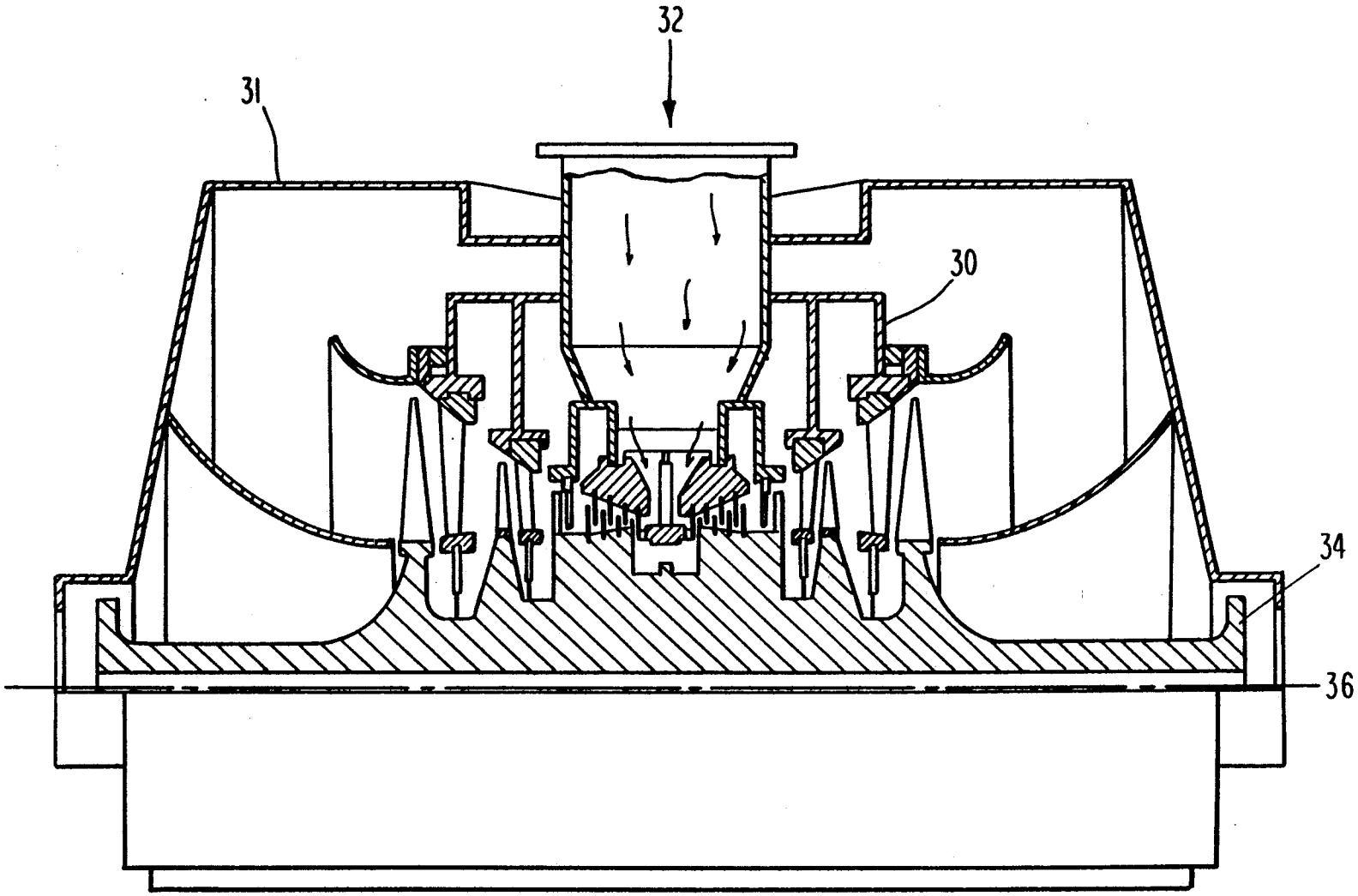
Fig. 1 PRIOR ART
FIG. 1 is a longitudinal cross-section of a typical low pressure steam turbine assembly.

Referring to FIG. 1, there is shown a longitudinal cross-section of a typical low pressure steam turbine. The operation and primary components of a typical turbine are well known to those of ordinary skill and are described in U.S. Pat. No. 4,863,341—Groenendaal, Jr., which is incorporated herein by reference. It will be understood that the improved support area which is a novel concept of the present invention is not visible in the view shown. Steam enters the turbine at the turbine inlet 32 and flows into and through the stationary blade assemblies and into and through the rotor blade assemblies which are attached to the rotor 34. The steam expands along the axial direction of the turbine, represented by the longitudinal center-line 36, causing rotation of the rotor 34. The turbine illustrated in FIG. 1 is illustrative only, and it is to be understood that variations in the turbine structure are within the scope of the invention.

Figure 2:
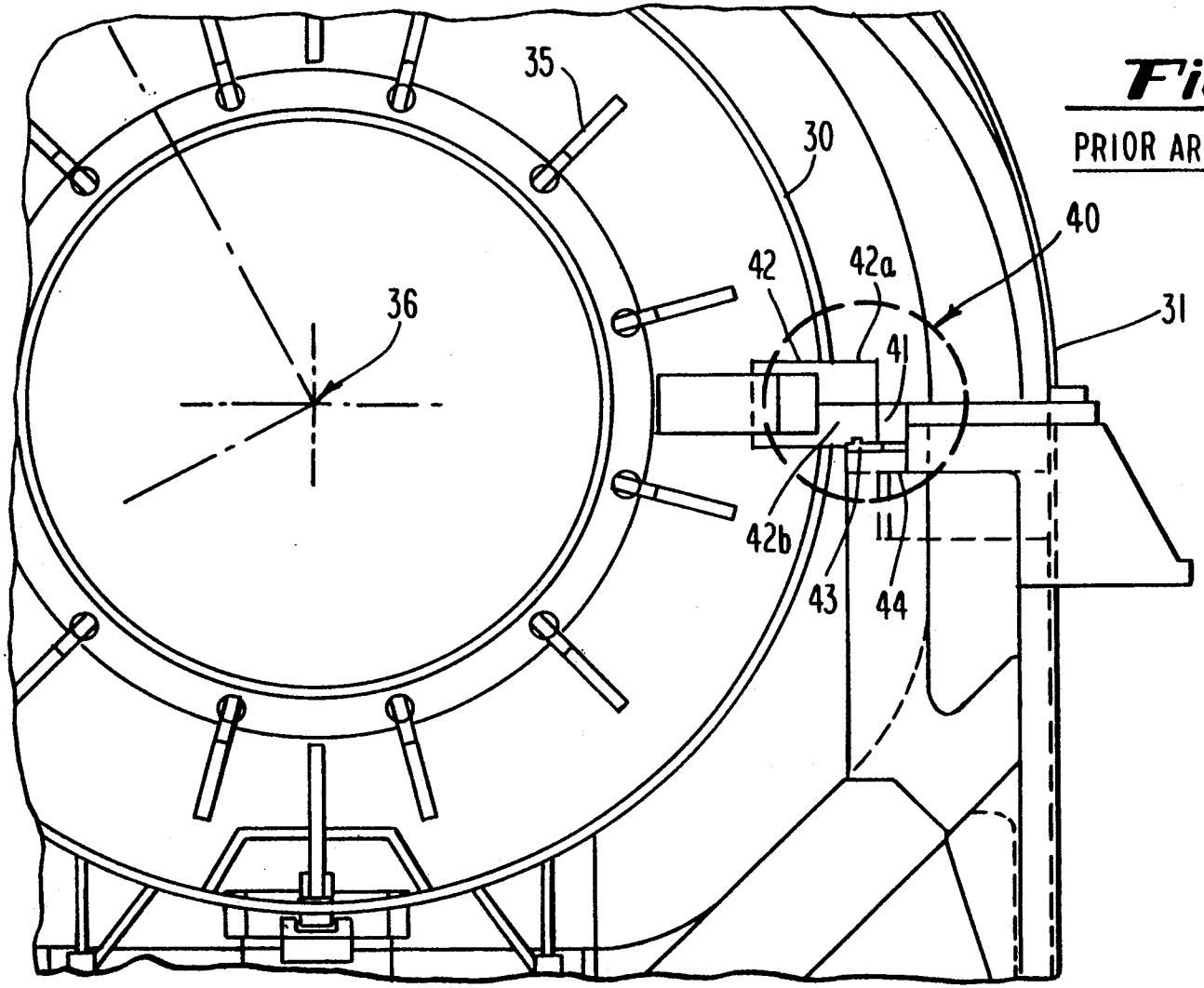
Fig. 2 PRIOR ART
FIG. 2 shows a lateral cross-section of the inner and outer cylinders of a typical low pressure steam turbine assembly, where the support area of the inner cylinder is highlighted at 40.

As shown in FIG. 2, the inner cylinder support area 40 primarily comprises the horizontal joint flange 42 which is comprised of the horizontal joint flange cover **42*a* and the horizontal joint flange base 42*b*, both of which are integral with one of the cylinder halves which form the inner cylinder 30. Integral with the horizontal joint flange base 42*b* is one of the support feet 41, an outward perpendicular projection of the flange base 42*b*. As discussed previously, the longitudinal centerline 36 of the turbine represents the axial orientation of the turbine and indicates the position of the rotor 34. Accordingly, the rotor blade assembly (not shown in FIG. 2) and the inner cylinder support area 40 are located along a radial axis of the turbine. The support area 40 further comprises the outer cylinder support shelf 44 which is integral with the outer cylinder 31. The support feet 41 are in sliding communication with the outer cylinder support shelf 44. A support liner 43 is positioned between the outer cylinder support shelf 44 and portions of the horizontal joint flange base 42*b* and the support feet 41. Adjusting the support liner's thickness provides for vertical adjustment between the inner cylinder 30 and the outer cylinder 31**.

Figure 3:
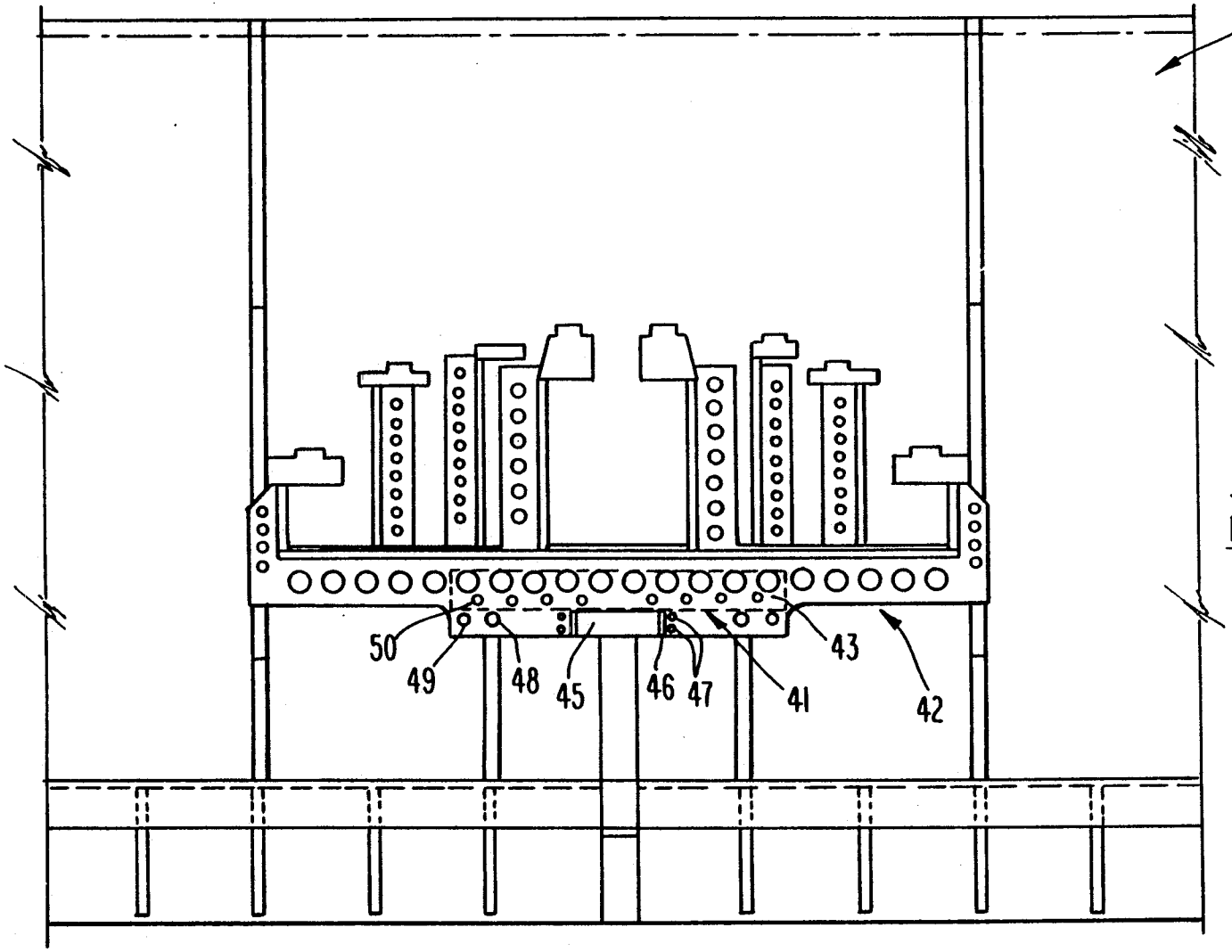
Fig. 3 PRIOR ART
FIG. 3 is a top view of the support area of a typical low pressure steam turbine assembly.

Excessive stiffness of the horizontal joint flange 42 combined with the thermal loads generally caused by operation of the steam turbine produce thermal bending moments in the flange and the cylinder rings and wall which results in ovality of the inner cylinder rings. In existing steam turbines, the horizontal joint flange 42 is slidably attached to the outer cylinder support shelf 44 and the current support area design has been found to cause undesirable flange stiffness. As shown in FIG. 3, existing turbines comprise a support area wherein the support feet 41 of the horizontal flange 42 are prevented from lifting off the outer cylinder support shelf by hold down bolts 48 which are axially aligned with the jacking bolts 49. Each of these bolts has a corresponding hold down bolt hole **48*a* and jacking bolt hole 49*a*. The hold down bolts are not tight; the nuts are backed off from clamping at this interface about 0.03 cm to permit free sliding due in the event of thermal expansion. The hold down bolts 48 are necessary to hold down the inner cylinder to prevent consequential damage to the unit under abnormal or emergency operating conditions, when the cylinder might be lifted off its supports. For example, a heavy rub on the traditional left side of the unit could lift the left side of the inner cylinder. Also, loss of a heavy blade group of blades could lift the entire cylinder. Jacking bolts 49 are necessary to raise the inner cylinder when the support liner 43** is not in place, or when the liner must be removed for replacement, resizing, or repair.

Referring once again to FIG. 3, the support foot 41 rests partly upon a support liner 43 which also supports the horizontal joint flange 42 upon the outer cylinder support shelf. Adjusting the support liner's thickness is the means of vertical adjustment between the inner and outer cylinders. In existing turbines the support liner 43 is mechanically affixed to the base of the horizontal joint flange 42 using a series of support liner bolts 50 in order to prevent movement of the support liner.

As shown in FIG. 3, the outer cylinder support shelf is constructed with an integral lug 45. An adjustable thickness liner 46 is provided in existing turbines in order to fill the gap between the support feet 41 and the lug 45, thus providing a means for axial positioning between the support foot 41 and the lug 45. In existing turbines, the adjustable thickness liner 46 is mechanically affixed to mounting holes 47 in the support feet 41. As shown in FIG. 3, there is a considerable amount of surplus material between the hold down bolt 48 and the mounting holes 47 for the axial positioning adjustable thickness liners 46. The present invention eliminates this surplus material thus providing the desired reduction in the radial width of the flange in the support area and a subsequent increase in the flange bending flexibility. A novel concept of the present invention provides an arrangement of the functional features in the support area in order to accommodate the narrowed flange and the appreciably smaller size of the support feet.

Figure 4:
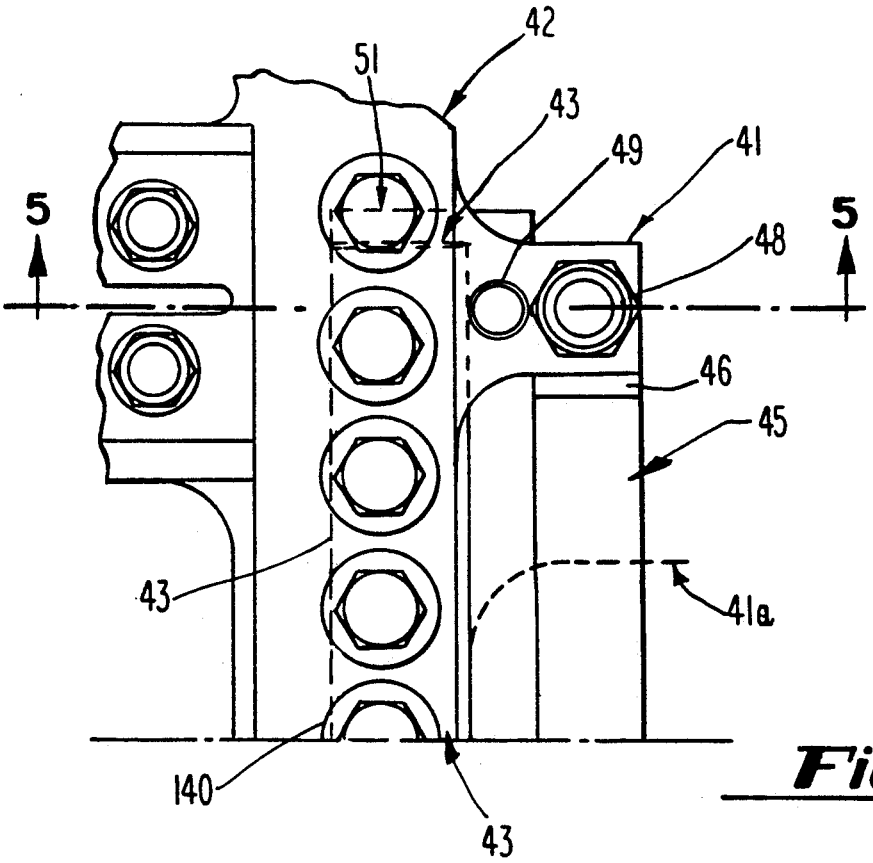
FIG. 4 is a broken away top view of the support area of a low pressure steam turbine made in accordance with the present invention.
Figure 5:
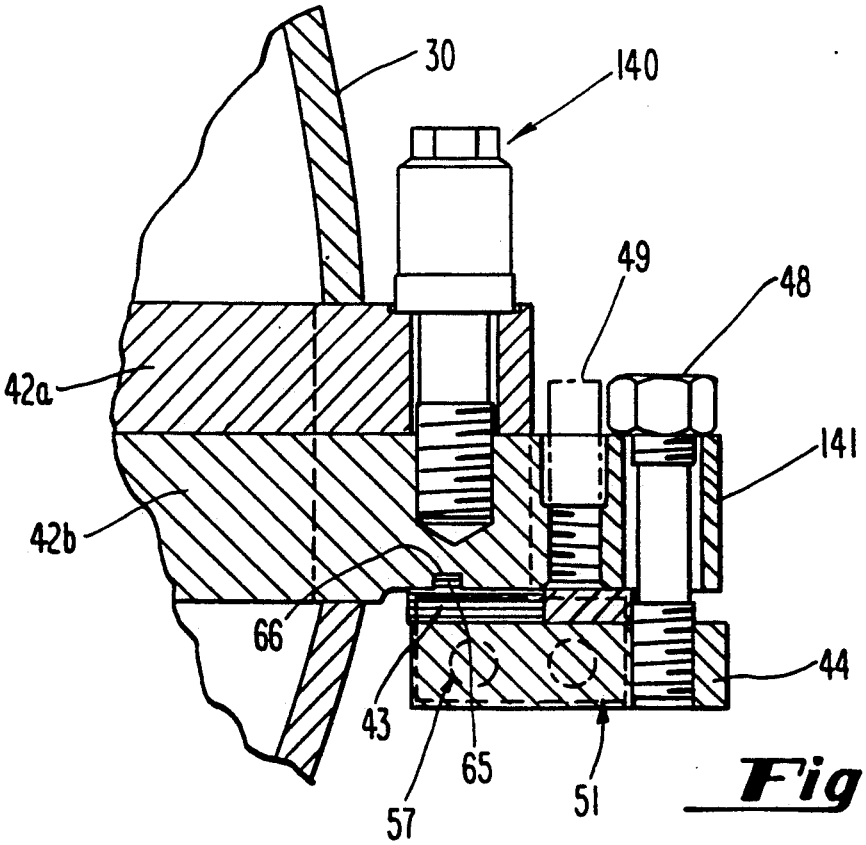
FIG. 5 is a broken away lateral cross-section along lines 5—5 of FIG. 4, showing the support area of a low pressure steam turbine made in accordance with the present invention.

Referring now to FIG. 4 and FIG. 5, there are presented detailed top and lateral cross-sectional views respectively of the support area of the present invention. Bolts 140 hold together the two sections of the inner cylinder by passing through the horizontal flange 42. The present invention increases the bending flexibility of the horizontal joint flange by narrowing the flange in the radial or transverse direction in the support area shown. As shown in the embodiment of FIG. 4, this results in an axially narrow, perpendicular projection of the flange which forms support foot 41. One of ordinary skill will appreciate the structurally simplified and overall improved support area of the present invention. The support foot 41 has an axial dimension which is minimized to just accommodate one bolt hole. Thus, surplus material is removed from the flange and, the support foot 41 is dramatically narrowed in the axial direction, compared with the previous dimensions in existing turbines as indicated by the dashed line 41*a*. In order to maintain the hold down and jacking features provided by the hold down bolts 48 and the jacking bolts 49 of prior designs, the present invention discloses a radial alignment of these bolts. Those of ordinary skill will appreciate that the removal of surplus material from the flange and from the support feet minimizes induced loads on the cylinder. Also, since there is a decrease in the number of occurrences where the flange pushes and pulls the rings out of round, the present invention provides that the non-axisymmetric portion of the loads on the various bolts used throughout the inner cylinder are reduced, thus providing more reliable bolting of the horizontal joint flange.

One of ordinary skill will appreciate that excessive holes in the horizontal joint flange result in stress concentration effects, thus leading to decreased low cycle fatigue life of the apparatus and flange cracking and leakage over time. As shown previously in FIG. 3, support liner 43 retention in existing turbines is provided by a plurality of retention bolts 50 which use corresponding holes in the horizontal joint flange 42. The present invention overcomes these problems and provides a simplified means of support liner retention which eliminates the holes in the horizontal flange. Elimination of the holes in the support liner also increases the line contact area, thus reducing contact stress. This is important since the liner runs hotter in the present invention as compared to existing designs, a phenomena which reduces its strength.

Referring to FIG. 5, the preferred means of support liner retention is shown. The support liner of the present invention 43 has an integral key protrusion 65. This key protrusion 65 fits into a slot 66 formed in the horizontal joint flange base 42*b*. This provides a means of retention of movement of the support liner 43 in the radial direction. In a preferred embodiment, retention of movement of the support liner 43 in the axial direction is provided by a support liner retainer plate 51. As shown in FIG. 4 and FIG. 5, the support liner retainer plate 51 is mechanically affixed to the outer cylinder support shelf 44 using bolts 57. As shown in FIG. 5, the retainer plate 51 butts up against the support liner 43 to provide retention of movement of the support liner 43 in the axial direction. One of ordinary skill will appreciate that various means of support liner retention which do not require bolting the support liner to the horizontal joint flange are possible and the final selection will be based on cost analysis. In most preferred embodiments of the present invention the support liner 43 is made of brass.

As shown in FIG. 4, the outer cylinder support shelf lug 45 of the present invention is larger in the axial direction as compared to that in the existing turbines shown in FIG. 3. The larger lug 45 is necessary to adjust the axial alignment of the cylinder and to provide a means for preventing rotation of the entire inner cylinder about a vertical central axis (yaw axis). As in existing turbines, in order to account for variations in the axial dimension of the lug 45 and the support foot 41, an adjustable thickness liner 46 is used to maintain the axial alignment. However, in order to avoid the stress concentration effects caused by mechanically affixing the adjustable thickness liner 46 to the support foot 41, in an embodiment of the present invention the thickness liner 46 is mechanically affixed to the outer cylinder support shelf. The method of mechanical engagement is within the ambit of design choices of the mechanical designer and will be based on the particular design specifications of the turbine.

Figure 6:
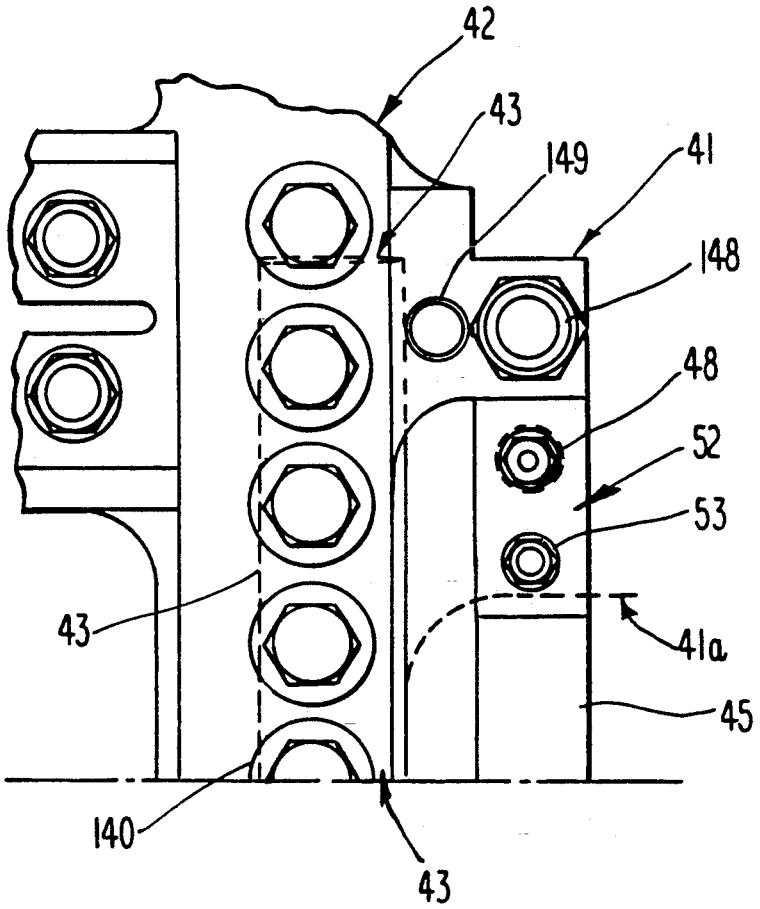
FIG. 6 is a broken away top view of the support area of a low pressure steam turbine made in accordance with the present invention for retrofit applications.

The present invention also comprises a method for modifying or retrofitting existing steam turbines in order to provide the features and benefits of the improved apparatus which are disclosed. As shown in FIG. 6, the retrofit steps include reducing the radial width of the flange 42 in the support area of an existing steam turbine by machining away at least as much support foot 141 material as required to expose the existing location of the hold down bolt hole 48. For retrofit units, the existing jacking bolt hole is reused as a new hole for hold down bolt hole 148 and a new hole is drilled and tapped into the modified support foot 141 for jacking bolt 149. This method results in the radial alignment feature of the hold down and jacking bolts, the novel arrangement necessary in order to accommodate the narrowed flange.

In order to adjust the axial alignment of the retrofitted cylinder, a spacer block 52 is provided to fit between the support foot 141 and the lug 45. The size of the spacer block 52 can be adjusted in order to provide the necessary means for maintaining axial translation of the inner cylinder. The spacer block 52 also provides a means for preventing rotation of the entire inner cylinder about a vertical central axis (yaw axis). The spacer block is mechanically affixed to the outer cylinder support shelf 44 with a bolt which reuses the existing hole for the hold down bolt 48 and a bolt which uses a new hole 53 which is drilled and tapped into the outer cylinder support shelf.

Although certain embodiments of the present invention have been described above with particularity, these embodiments are exemplary and not meant to limit the scope of the present invention. Numerous variations and departures from the examples set forth above will immediately present themselves to those of ordinary skill. Accordingly, reference should be made to the appended claims in order to ascertain the scope of the present invention.

We claim:

1. Low pressure steam turbine apparatus having inner and outer cylinders, said outer cylinder having a support shelf, and inner cylinder support means for providing flexible support of said inner cylinder on said outer cylinder, said support means comprising a horizontal joint flange and at least one support foot integrally connected thereto which projects substantially radially outward from said horizontal joint flange, said support foot being in sliding communication with said support shelf, and wherein said at least one support foot has a jacking bolt hole and a hold down bolt hole spaced radially one from the other, said foot further having an axial dimension limited to accommodate said bolt holes.

2. The steam turbine apparatus as described in claim 1, further comprising a support liner secured between said outer cylinder support shelf and respective portions of said support foot and said horizontal joint flange, said support liner extending in the axial direction of said horizontal joint flange and comprising a key which protrudes from the upper surface thereof, said horizontal joint flange having an axially extending slot grooved into its lower surface for receiving said key, and a support liner retainer plate, said support liner retainer plate butted up against said support liner, and wherein said retainer plate is mechanically affixed to said support shelf for restraining axial movement of said support liner.

3. The steam turbine apparatus of claim 2, comprising a jacking bolt positioned in said jacking bolt hole for raising said inner cylinder above said outer support shelf, and a hold down bolt positioned in said hold down bolt hole for holding said horizontal joint flange to said outer cylinder support shelf.

4. The steam turbine apparatus of claim 1, wherein said outer cylinder support shelf has at least one lug integral therewith and extending upward therefrom, and comprising an adjustable thickness liner, said thickness liner secured between said at least one lug and said support foot, and wherein said thickness liner is mechanically affixed to said support shelf for restraining axial translation or rotational movement of said inner cylinder.

5. Steam turbine apparatus having inner and outer cylinders, said outer cylinder having a support shelf, and inner cylinder support means for providing flexible support of said inner cylinder on said outer cylinder, said support means comprising a horizontal joint flange having a radially extending support foot portion, characterized by said each support portion foot having a jacking bolt hole and a hold down bolt hole spaced radially one from the other, a hold down bolt connecting said foot portion and said outer cylinder said foot further having an axial dimension limited to accommodate said bolt holes, whereby the effective radial width of said flange is reduced.

* * * * *